US006248232B1

(12) United States Patent
Stoner

(10) Patent No.: US 6,248,232 B1
(45) Date of Patent: Jun. 19, 2001

(54) PORTABLE DEBRIS REMOVER

(76) Inventor: Michael A. Stoner, 1225 Upper Tom Burke, Gallatin Gateway, MT (US) 59730

( * ) Notice: Subject to any disclaimer, the term of this patent is extended or adjusted under 35 U.S.C. 154(b) by 0 days.

(21) Appl. No.: 09/417,977

(22) Filed: Oct. 13, 1999

Related U.S. Application Data

(63) Continuation-in-part of application No. 08/929,705, filed on Sep. 15, 1997, now Pat. No. 6,019,891.

(51) Int. Cl.[7] ..... E04H 4/16

(52) U.S. Cl. ..... 210/136; 210/169; 210/238; 210/416.2; 15/1.7

(58) Field of Search ..... 210/136, 169, 210/238, 416.1, 416.2; 15/1.7; 4/490, 496

(56) References Cited

U.S. PATENT DOCUMENTS 24,551 * 6/1859 Stoner .
1,480,562 * 1/1924 Mock .
1,582,399 * 4/1926 Helander .
2,218,941 * 10/1940 Thompson .
2,672,987 * 3/1954 Hutchinson .
2,761,833 * 9/1956 Ward .
2,956,507 * 10/1960 Hutchinson .
3,158,104 * 11/1964 Hutchinson .
3,407,430 * 10/1968 Renner .
3,820,182 * 6/1974 Vockroth .
4,094,031 * 6/1978 Cellini .
4,584,733 * 4/1986 Tietge et al. .
4,935,015 * 6/1990 Wilinger .
4,935,980 * 6/1990 Leginus et al. .
5,095,571 * 3/1992 Sargent .
5,122,285 * 6/1992 Tartal .
5,135,647 * 8/1992 Childers .
5,279,730 * 1/1994 Chen .
5,311,631 * 5/1994 Smith, Jr. .
5,384,928 * 1/1995 Khoury .
6,019,891 * 2/2000 Stoner .

* cited by examiner

*Primary Examiner*—Duane Smith
*Assistant Examiner*—Fred Prince
(74) *Attorney, Agent, or Firm*—Holms Roberts & Owens LLP

(57) ABSTRACT

A portable debris remover for use under the surface of a volume of water collects or removes debris from an underwater surface by entraining the debris into water and then filtering the water. The portable debris remover includes a body housing with a body mechanism that includes an inlet to receive water with the entrained debris and an outlet configured to discharge water after filtering. A hand operated squeezable bulb is connected to the housing and is operable between an at-rest position and a compressed position. As the bulb is squeezed to the compressed position, water is urged outwardly though the filter and past an open outlet check valve at the outlet. As the bulb is released to return to the at-rest position, some water comes in past the outlet check valve to back flush and clean the screen before the outlet check valve closes. Thereafter, water is urged into the bulb through the now open inlet check valve. The bulb is removable from the body housing so that debris can be removed from the bulb. An extension may be used to position the bulb for more favorable access by the user.

25 Claims, 10 Drawing Sheets

PORTABLE DEBRIS REMOVER

CROSS REFERENCE TO RELATED APPLICATION

This application is a continuation-in-part of application Ser. No. 08/929,705, filed Sep. 15, 1997, which is now U.S. Pat. No. 6,019,891.

BACKGROUND

1. Field of the Invention

The present invention relates to a portable debris remover for use in removing debris that is on a bottom surface under the liquid surface of a liquid in a structure configured to contain the liquid, including debris which collects on the bottom surface of spas, hot tubs, swimming pools or the like, by vacuuming the debris from the bottom surface into the remover and retaining the debris in the remover.

2. State of the Art

Devices to vacuum or otherwise remove debris from a pool, spa, hot tub or similar body or volume of water include vacuums, screens, filters, and pumps. See, e.g., U.S. Pat. Nos. 4,094,031 (Cellini); 3,820,182 (Vockroth); 4,584,733 (Tietge, et al.); 4,935,980 (Leginus); 5,095,571 (Sargent); 5,135,647 (Childers); 5,311,631 (Smith, Jr.); 5,384,928 (Khoury); and 5,122,285 (Tartal). Such devices typically focus on removing leaves, twigs, large insects, and similar materials, which, all together, can be characterized as large debris. Pools, spas, hot tubs and similar bodies of water or other liquids may collect fine sand, very small pieces of dirt or grit, tiny stones and similar materials which, all together, may be referred to as small debris. Small debris may be introduced in a variety of ways including, for example, on the feet of users, by being blown in by the wind, or by chemical formation with various chemicals in the liquid (e.g., chlorine in pool and spa water).

The small debris may collect on the bottom and may be seen. On occasion it may not be visually apparent or noticed in, for example, pools and spas, until a user is in the pool or similar body or volume of water and can feel it under the user's feet or with the hand. After the user is in the pool, spa, hot tub, or the like, use of known cleaning devices may be inconvenient, impractical or undesirable.

Spas and hot tubs may be made of different kinds of materials, including but not limited to, synthetic or plastic-like materials including fiberglass. Spas and hot tubs, like any other container for a liquid, are typically found with a bottom surface and one or more sitting surfaces. Some swimming pools including shallow pools may be similarly constructed. Some pools and some spas or hot tubs may have or include interior surfaces that may have been tiled. In effect, the surfaces oriented toward the water or the interior are finished in a variety of ways to be smooth, polished or glass like. Such surfaces could in some cases be scratched or etched by sand particles, small stones or the like, e.g., small debris. Although preferable to remove the small debris to avoid etching or scratching the interior surface and certainly to avoid the associated discomfort, removal is not easily effected because the user typically finds the material during use of the pool, spa, hot tub or the like. Existing tools do not easily lend themselves to removal and because hand held tools for cleaning an under water surface by a user in the pool are not known.

Of course to remove small debris from other liquids is typically desired in order to maintain quality or purity for example, oils, fruit juices, gasoline or the like may also be heavily filtered and yet collect small debris that can be seen or in some cases felt.

Devices using a bulb to in effect aspirate or pump to cause movement of water with entrained debris for cleaning are known. See, e.g., U.S. Pat. Nos. 2,956,507 (Hutchinson); 2,672,987 (Hutchinson); 3,158,104 (Hutchinson); 3,549,015 (Willinger); 1,480,562 (Mock).

A hand held device to easily remove small debris from bottom surfaces by a user manipulating the device with the user's hand holding the device under water is not known. A hand held device to remove small debris from other liquids like gasoline or the like is also not known.

SUMMARY OF INVENTION

A portable debris remover is provided for use under the liquid surface of a volume of water or other liquid (e.g., gasoline, vegetable oil, fruit juice, or any other fluid that could have debris that a user would like to remove) within a structure having at least one surface under the liquid surface. The portable debris remover collects or removes debris from the surface under the liquid surface by entraining the debris into water or other liquid and filtering the water or other liquid. The debris on the surface under the liquid surface is first entrained in the water or other liquid as the water or other liquid is urged toward and into the debris remover. Then the water or other liquid with entrained debris is filtered to remove the debris from the water or other liquid as the water or other liquid is returned to the volume of water or other liquid from which it came. The portable debris remover includes a body for positioning under the surface of the volume of water or other liquid. The body has an inlet for positioning to receive water or other liquid with entrained debris from proximate the liquid surface. The body also has an outlet configured to discharge water or other liquid to the volume of water or other liquid.

The portable debris remover has a bulb for positioning under the surface of the volume of water or other liquid. The bulb has a bulb opening configured to connect to the body with the inlet and the outlet of the body in or proximate to the bulb opening. The bulb is formed of a squeezable material operable by the hand of the user between an at-rest position in which the bulb defines a first volume and a compressed position in which the bulb defines a second volume which is less than the first volume. In effect the bulb is squeezed by the hand to reduce the volume and then released to return to an at-rest condition to effect a pumping action to intermittently create a suction at the inlet.

An inlet check valve is positioned relative to the inlet and operable between an open position and a closed position. In the open position, water or other liquid flows into the bulb through the bulb opening upon movement of the bulb from the compressed position to the at-rest position. The inlet check valve moves to the closed position when water or other liquid flows out of the bulb through the bulb opening upon movement of the bulb from the at-rest position to the compressed position.

An outlet check valve is positioned proximate the outlet and is operable between an open position and a closed position. The outlet check valve moves to the open position when water or other liquid flows out of the bulb through the bulb opening upon movement of the bulb from the at-rest position to the compressed position. The outlet check valve moves to the closed position by water or other liquid flowing into the bulb opening upon movement of the bulb from the compressed position to the at-rest position.

The portable debris remover also includes a screen positioned proximate the outlet to filter the debris from the water or other liquid before the water or other liquid passes through the outlet.

In a preferred embodiment, the portable debris remover includes a nozzle for attachment to the body. The nozzle is formed for contact with and movement over the bottom surface of the structure and to entrain debris in the water or other liquid urged into the inlet upon movement of the bulb from the compressed position to the at-rest position. Desirably, the nozzle has a bottom surface for contact with the bottom surface of the structure with the liquid. Also the nozzle desirably has a front with ports formed to receive and pass the water or other liquid with the debris entrained. The nozzle also desirably has a rear spaced from the front and formed to urge debris toward the front and into a nozzle chamber upon movement of the nozzle along the bottom surface of the structure.

Even more preferably, the body of the debris remover has an axis. The body with the nozzle is formed to be oriented or positioned relative to the bottom surface of the structure to be at an angle between the axis and the bottom surface less than ninety degrees. In a preferred arrangement, the bottom surface is flat. The undersurface or bottom of the nozzle is also flat. With the flat bottom of the nozzle positioned in general alignment with the flat surface of the bottom of the structure, the axis is from about twenty degrees to about fifty degrees. Most preferably the axis is from about thirty-five degrees to about forty degrees.

In one configuration of the portable debris remover, the outlet is positioned above the inlet when the portable debris remover is held in the hand and positioned for use in the volume of water or other liquid. The screen is positioned proximate the outlet to inhibit the flow of debris there through with water or other liquid flowing out the outlet. In effect the screen filters the debris from the water or other liquid. Since the screen is generally planar and positioned generally transverse to said axis, the heavier debris can roll off and collect in the bulb. The bulb is sized and shaped to collect debris falling from the screen. With the portable debris remover held with its axis from about twenty degrees to about fifty degrees and preferably about forty degrees, the debris collects at about the lip of the bulb.

In yet another configuration, the portable debris remover is sized and made of materials selected so that the portable debris remover has positive buoyancy with the bulb in the at-rest position and defining the first volume which may even be substantially or entirely full of water or other similar liquid. That is, the debris remover 80 is typically stored out of the water or other liquid perhaps on a nearby hook or in a nearby storage device. Thus, the bulb 82 will fill with air. Upon submersion to begin use to effect cleaning operations, the manipulation to the compressed condition 130 when oriented as shown in FIG. 1 does not normally force all the air in the bulb 82 out of the bulb 82. The air trapped in the bulb 82 along with the positive buoyancy attributed to the bulb material itself provides for sufficient positive buoyancy so that the debris remover 80 as so configured will float on the surface of the water or other similar liquid. A similar liquid is one that has similar physical characteristics.

In a preferred arrangement, the body 86 is formed to have an outlet chamber with a sidewall. An aperture is formed in the sidewall of the outlet chamber to communicate between the exterior of said portable debris remover and the outlet chamber. The aperture is sized to allow the water or other liquid to flow therethrough. Thus when the debris remover is lifted above the surface of the water, the water in the bulb and elsewhere in the portable debris remover can drain with the remover positioned with the outlet check valve open.

In a more desirable configuration, a portable debris remover of the invention has an outlet check valve positioned proximate to the outlet. The outlet check valve is operable between an open position and a closed position. In the open position, water or other liquid flows out of said the bulb through the bulb opening upon movement of the bulb from the at-rest position to the compressed position. The outlet check valve is configured to move toward the closed position upon the urging of water or other liquid flowing into the outlet toward the bulb upon movement of the bulb from the compressed position to the at-rest position.

Preferably the nozzle of the inventive portable debris remover has an exterior wall defining a nozzle chamber. The nozzle wall has a bottom surface for contact with the bottom surface of the structure with the liquid. The nozzle wall has a front with ports formed to receive the water or other liquid with debris entrained. The nozzle wall also has a rear spaced from the front and formed to urge debris into the nozzle chamber upon movement of the bottom surface along the bottom surface of the structure.

DESCRIPTION OF THE PREFERRED EMBODIMENTS

The disclosure and description of application Ser. No. 08/929,705, filed Sep. 15, 1997 which is now U.S. Pat. No.

6,019,891 to which this application is related is incorporated herein in its entirety by this reference.

Figure 1:
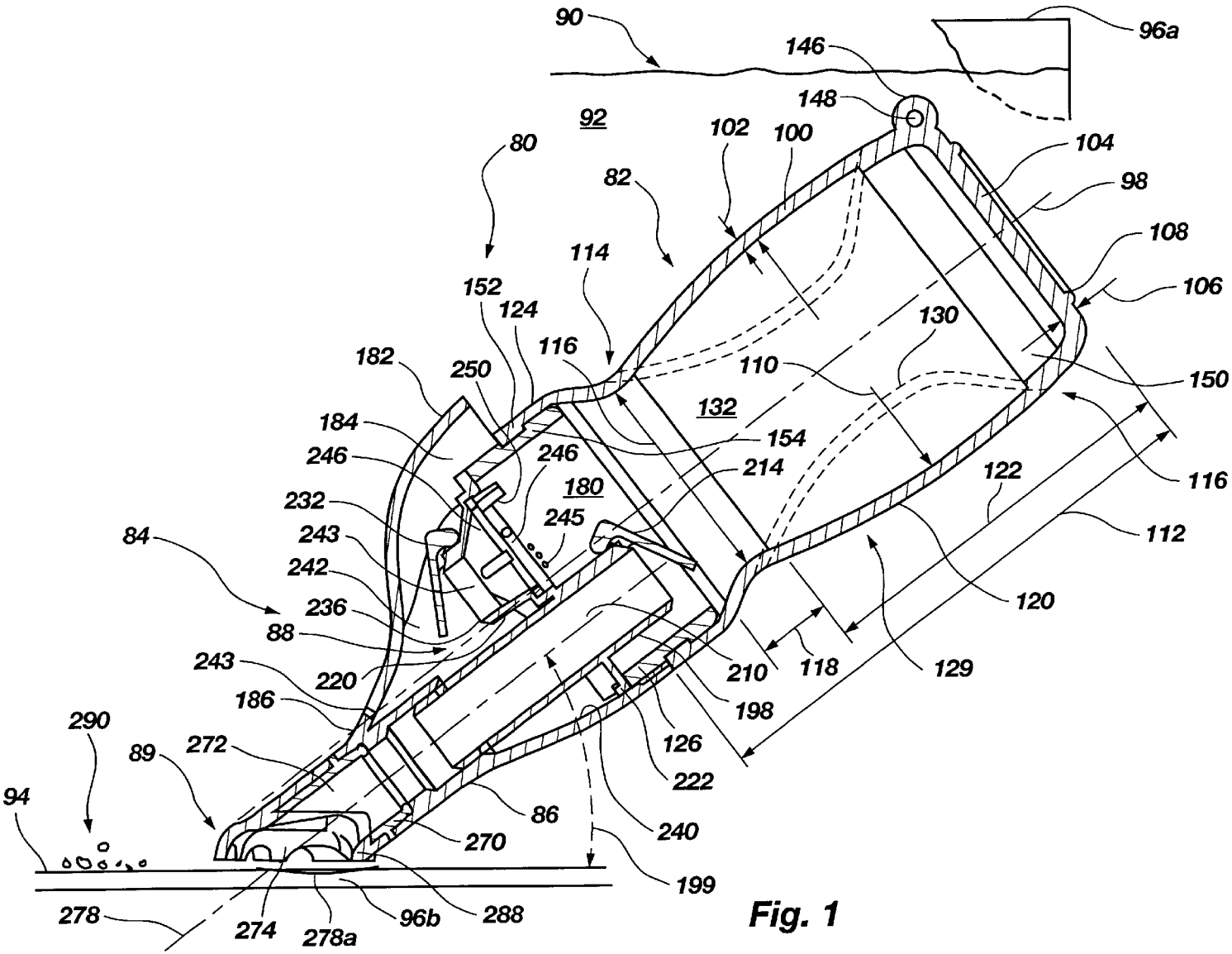
FIG. 1 is an side cross sectional view of an assembled portable debris remover of the present invention.

Referring to FIG. 1, a portable debris remover 80 has a bulb 82 attached to a body 84 that includes an body housing 86 with a body mechanism 88 and a nozzle 89. The portable debris remover 80 is configured for use under surface 90 of a volume of a liquid such as water 92 that is contained or positioned within a structure 96*a* and 96*b*. The structure 96*a* and 96*b* is shown only in part and has at least one underwater or bottom surface 94. The bottom surface 94 may be any surface that is under the surface 90 of the liquid contained in the structure 96*a* and 96*b*. The structure 96*a* and 96*b* may be a swimming pool, a spa, a hot tub or the like or any other structure or container configured to contain a liquid.

The underwater or bottom surface 94 may be the bottom or an intermediate step. As shown, the underwater or bottom surface 94 is typically flat and smooth. However, an irregular surface particularly one that is sometimes referred to as a "non-skid" surface is also suitable. Indeed, other surface shapes may also be cleaned leading to a corresponding change in the undersurface of the nozzle 89 to form a mechanical seal sufficient so that the small debris can be removed. Thus, for example, the underwater or bottom surface 94 could be rounded or spherical with a radius of curvature of 4 feet while the nozzle is formed to have a surface that can be said to have a radius of curvature from 3.5 feet to 4.5 feet. Even though not a tight fit, the nozzle 89 is believed to effect a sufficiently close mechanical seal to allow for the water to entrain the small debris. Of course, if the nozzle 89 is preferably formed of a material such as plastic that is pliable or bendable so it may be forced into a substantially tight fit or a fit in which the bottom surface 99 and the nozzle underside surface are close enough to effect removal of the debris.

The bottom surface 94 may be of the type that can be scratched or etched by urging stones, glass, metal objects, or other hard objects therealong. Spas and hot tubs are typically made of a plastic-like material including appropriately treated fiberglass. Such materials can be scratched or marred by an abrasive object pressed against and moved along the surface. Other similar enamel-like surfaces may also be etched over time by not only the large debris but also the small debris.

The grit or dirt may, for example, be carried in by users or even blown in by the wind. Large materials are easily noted and removed using appropriate tools or methods. However, smaller grains of sand and gravel may be hard to move and will take some time to settle. Even after settling, they can be again easily suspended or entrained in the water. Grit or granules may also be formed in the water due to interaction of various chemicals in the water or placed in the water. For example, chlorine may be added and interact with various other materials to form a precipitate that is gritty in character.

When a hot tub or spa is operated (water circulated by pump), sand and grit is often re-suspended in the water. The sand or grit may also collect in areas on the bottom based on water movements or currents. Removal may be difficult particularly during use.

Removal of the dirt or grit is desirable because users may find it uncomfortable to stand or walk on, or uncomfortable to sit on, surfaces that have the dirt or grit thereon. Removing the small amounts of dirt or grit that collect but are difficult to remove using large clearing tools or machines is desired because the useful life of the involved structure will be enhanced while at the same time improving the quality of the water or other liquid and the quality of the experience to the user. The portable debris remover 80 has been found to be particularly suitable to remove the small dirt and debris.

The portable debris remover 80 has a bulb 82 made of a rubber-like material that may in fact be rubber or any material with similar characteristics. More specifically, the material of the bulb 82 is selected to be deformable by manipulation of the human hand. It has been found that the bulb 82 is desirably made of a material with a durometer from about 20 to about 80.

The bulb 82 is preferably shaped to be circular in cross section but with a variable diameter along its central axis 98. That is, the bulb 82 is shaped to facilitate use. The side wall 100 of the bulb 82 has a wall thickness 102 selected so that the bulb 82 may be readily and repetitively squeezed by the human hand to effect a pumping action as discussed hereinafter. In the preferred embodiment, the bulb 82 is made of a rubber-like material having a durometer of about 50 with a wall thickness 102 of about ⅛ of an inch. However, the wall thickness 102 may range from about 1/64 of an inch to about ¼ of an inch as desired.

The bulb 82 also has a rear wall or heel 104 that is formed to be generally transverse to the axis 98 and of the same material as the side wall. The rear wall or heel 104 is unitarily formed with the side wall 100, but with a wall thickness 106 that is selected to be greater than the wall thickness 102 of the side wall 100. Further, the heel 104 is formed with a circular ridge 108 which is generally planar transverse to the axis 98 to provide a substantially rigid structure so that the debris remover 80 itself may be placed on a surface near the place of use with the axis 98 normal to the surface. In short the debris remover may be stood up on a nearby flat and substantially horizontal surface when not in use.

As stated, the heel 104 has a wall thickness 106 greater than the wall thickness 102 of the side wall 100 so that a pumping action can be more easily effected by the user employing the forefinger and thumb of the hand as discussed later. That is, if bulb 82 were to be formed with a rear wall of about the same thickness as the side wall 100 so that the rear wall was easily or readily deflectable or deformable, the user would need to employ more of the hand to operate or effect the squeezing action to effect a pumping action. Thus the rigid or substantially rigid heel 104, which is about ¼ of an inch thick 106, is preferred and facilitates a regular and repetitive squeezing action in use.

As seen in FIG. 1, the bulb 82 has a variable diameter 110 along its length 112 with a necking portion 114 sized with a diameter 116 and a length 118 to accept the forefinger and thumb of a user grasping the bulb 82. That is, the bulb 82 is shaped to have a mid section 120 that has a length 122 sized to accept the hand 128 (shown in phantom in FIGS. 12 and 14) of an adult user. In turn, the bulb 82 has a diameter 110 from about 2⅜ inch at the largest diameter to a diameter 116 of about 1¾ inch at the necking portion 114. The bulb 82 is about 4⅝ inch long 112, and is selected so that a portion 124 extends forward of the necking portion 114 for connection to a bulb collar 126 for further connection to the body housing 86. Thus, the bulb 82 may be manipulated or pumped using the squeezing action of the hand or by compressing the thumb and forefinger as stated hereinafter.

Figure 12:
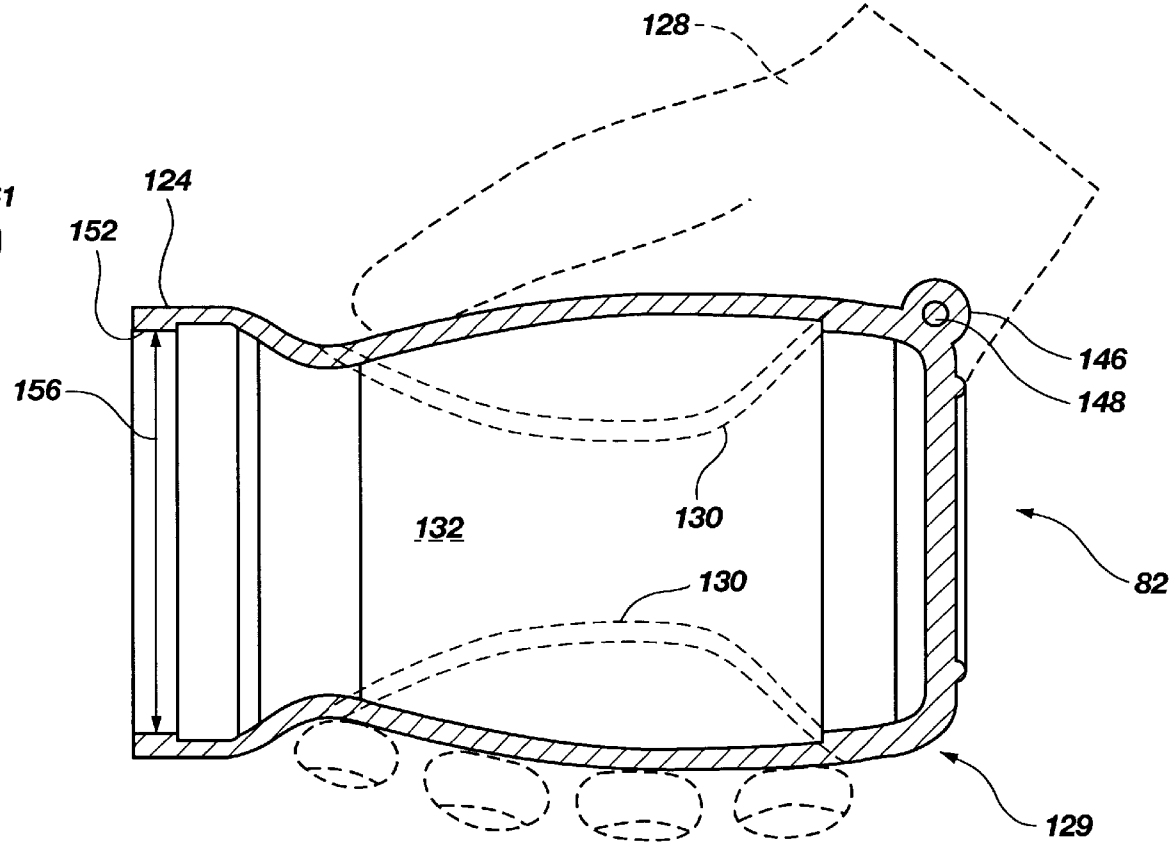
FIG. 12 is a side cross sectional view of a bulb for use with the portable debris remover of the present invention.
Figure 13:
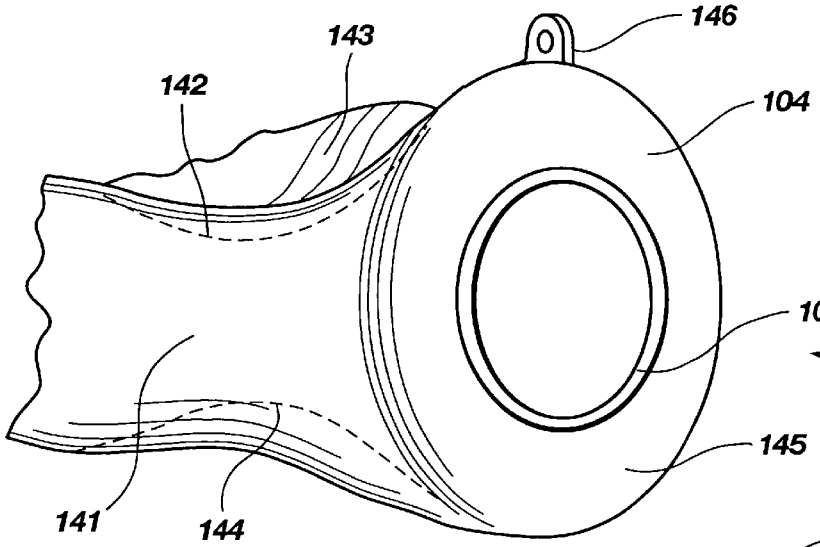
FIG. 13 is a partial rear perspective view of the bulb of FIG. 12 in a compressed condition.
Figure 14:
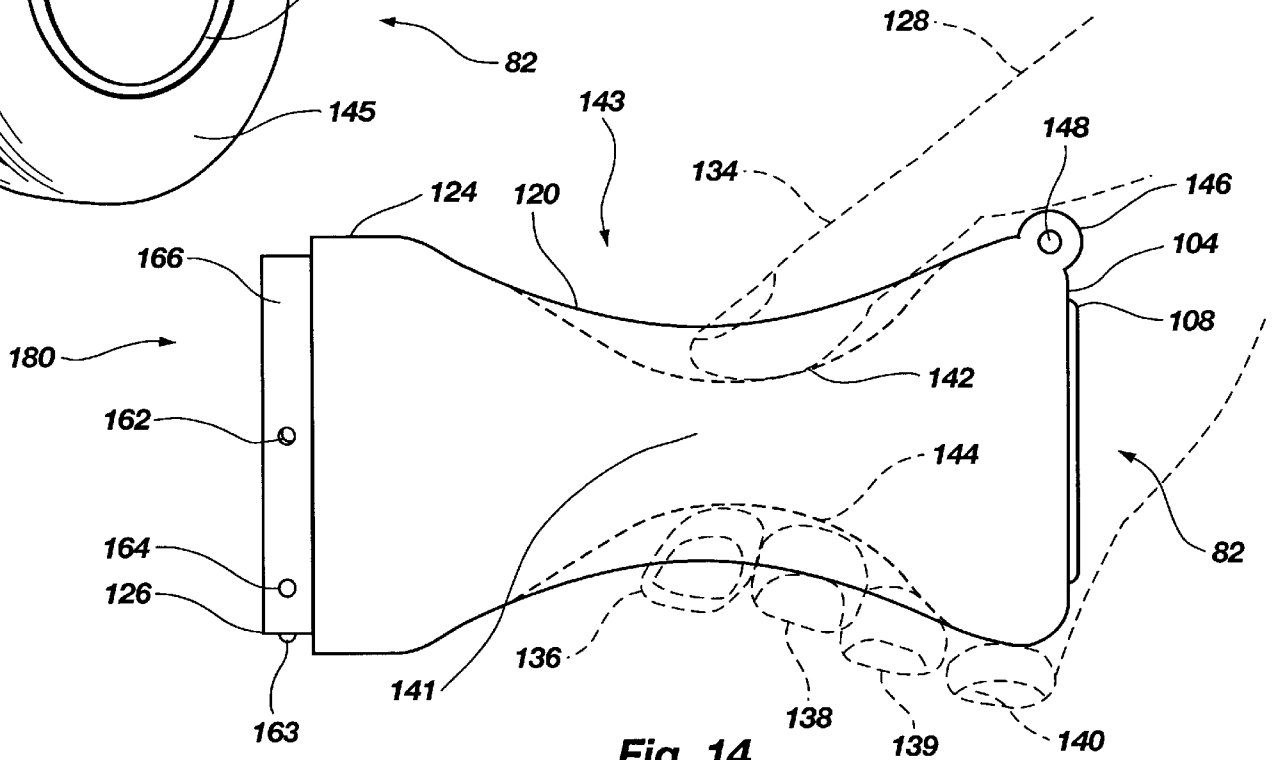
FIG. 14 is a side view of the bulb collar and bulb of FIGS. 11 and 12 with the bulb in a compressed condition.

With the bulb 82 formed, sized and shaped as described, the hand 128 of an adult (both male and female) can easily manipulate the bulb 82 between its at-rest position 129 shown in solid in FIGS. 1 and 12 and a second or compressed position 130 depicted in FIGS. 13 and 14. More specifically, the side wall 100 is deflected toward the interior 132. In turn, the volume of the bulb 82 changes from about 400 milliliters at its at-rest volume to a compressed volume that can vary from slightly less than 400 milliliters (e.g., 350 milliliters) to less than 200 milliliters. The volume of the bulb 82 thus reduces from the at-rest position 129 to the compressed position 130 by an amount that depends on the squeezing action of the user's hand and may even exceed fifty percent.

Turning to FIGS. 13 and 14, the bulb 82 is shown as if compressed using principally the squeezing force of the thumb 134 and forefinger 136. The other fingers 138, 139 and 140 of the hand 128 are also shown and typically apply some force as the bulb 82 is squeezed from at-rest position 129 to the compressed position 130. As side wall 100 is urged into the interior 132, left and right portions 141 and 143 of side wall 100 expand or displace outwardly with top portion 142 and bottom portion 144 approaching each other and in some cases coming into contact with each other. The heel 104 with its ridge 108 remains relatively rigid deflecting only along or around its outer perimeter 145 proximate the side wall 100. With the heel 104 rigid, the manipulation of the thumb 134 and forefinger 136 can effectively cause displacement from the at-rest position 129 to the compressed position 130 to effect a pumping action easier than if the heel 104 deflected so that the other fingers 138–140 would be involved in a more complete squeezing action.

As should be clear from the illustrations of FIGS. 1 and 12–14, when the hand 128, and more specifically the thumb 134 and forefinger 136, are relaxed, the wall 100 elastically returns from a compressed position 130 to the at-rest position 129 (FIGS. 1, 12 and 13) thereby creating an aspirating or pumping action to, in effect, create a suction to draw liquid into the bulb 82. With the wall thickness 102 selected to be about ⅛ of an inch and the heel 104 selected with a thickness of about ¼ inch, and with the material of the bulb 82 selected to have a durometer of about 50, and with the bulb 82 sized to provide a volume of about 400 milliliters, manipulation by a typical female adult can yield a vacuum of about 45 inches of water as the wall 100 travels from the compressed position 130 to the at-rest position 129.

The portable debris remover 80 is sized and made of materials selected so that the portable debris remover has positive buoyancy with the bulb 82 in the at-rest position and with the bulb 82 substantially full of water or other liquid. That is, the debris remover 80 is typically stored out of the water or other liquid perhaps on a nearby hook or in a nearby storage device. Thus, the bulb 82 will fill with air. Upon submersion to begin use to effect cleaning operations, the manipulation to the compressed condition 130 when oriented as shown in FIG. 1 does not normally force all the air in the bulb 82 out of the bulb 82. The air trapped in the bulb 82 along with the positive buoyancy attributed to the bulb material itself provides for sufficient positive buoyancy so that the debris remover 80 as so configured will float on the surface of the water or other liquid.

It may also be noted that the heel 104 has a wall thickness 106 as discussed which also provides the bulb 82 with a rigidity so that it may be hung by the eye 146. That is, a string or other type of material may be threaded through the hole 148 in the eye 146 so that it may be hung on a hook or similar protrusion when not in use. When hung by the eye 146, the weight or mass of the debris remover could cause the bulb 82 to distort. However, the wall thickness 106 of the heel 104 is selected along with the materials of construction so that the heel 104 does not materially distort.

In FIG. 1, the bulb 82 is shown having a reinforcing section 150 that is not shown in FIG. 12. The reinforcing section is optional to strengthen the heel 104. In FIG. 1, it may also be seen that the bulb 82 is formed with a lip 152 which is sized to snugly fit in recess 154 of the collar 126. The inside diameter 156 at the lip 152 is less than the outside diameter 158 of the cylindrically shaped collar 126 and the outside diameter 160 of the recess 154. In turn the bulb 82 must be elastically stretched or deformed to effect a snug and effectively water tight and air tight connection between the bulb 82 and the collar 126. The collar 126 has a beveled rear edge 161 to facilitate placement of the bulb lip 152 into the recess 154. Upon placement, the frictional relationship between the bulb 82 and the collar 126 is sufficient to allow the user to connect and remove the bulb 82 with collar 126 from the body housing 86. Upon installation or connection, the bulb lip 152 is elastically deformed or stretched about the recess 154 to effect a connection tight enough so that rotating forces applied to the bulb 82 are translated to the collar 126. In turn, the collar 126 may be locked to the body housing 86 by rotating the bulb 82 with the hand of the user as discussed hereinafter.

Figure 11:
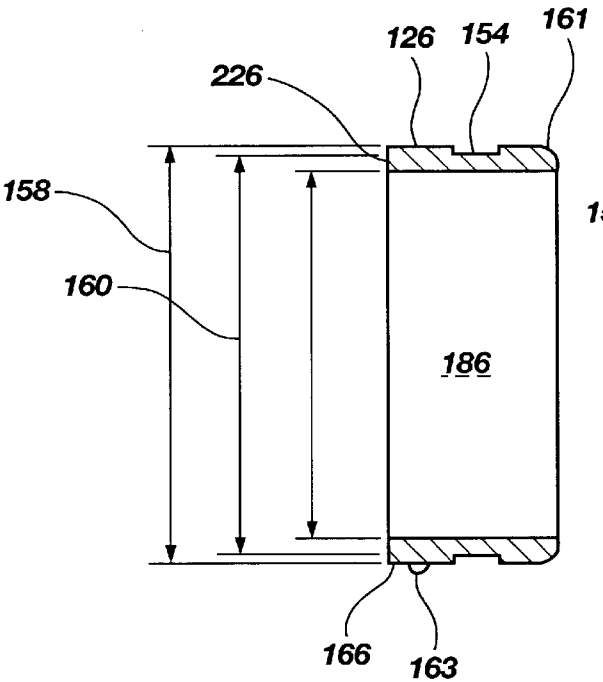
FIG. 11 is a side cross sectional view of a bulb collar for use with the portable debris remover of the present invention.

To effect a connection between the collar 126 and the body housing 86, the collar 126 has one or more raised buttons 162, 163, 164 (FIGS. 11 and 14) and preferably 4 raised buttons (one not shown) disposed radially about the perimeter 166 of the collar 126. After assembly of the bulb 82 with the collar 126, the collar 126 is positioned for connection to the body housing 86 with the raised buttons 162–164 in alignment with corresponding locking keyways 168 and 169 (others as necessary not shown). The locking keyways 168 and 169 are disposed radially around the interior perimeter 170 of the body housing 86 with at least two locking keyways being diametrically opposite each other. Desirably, there are four locking keyways with one each being placed at 90, 180, 225 and 270 degrees using the top 172 as the 0 degree starting point. Other disposition of locking keyways may be used as desired.

Each locking keyway, such as locking keyways 168 and 169, has a mouth 173 sized in width more than the diameter of the corresponding raised button such as buttons 162–164. The sides 174 of the mouth 173 are angled to facilitate alignment of the raised button and entry of the button into the throat 176 and from there upon relative rotation of the collar 126 and the body housing 86 into detent 178. That is, the body housing 86 is made of a material that elastically deforms (such as a suitable plastic). The buttons 162–164 produce an effective diameter for the collar 126 that is slightly more than the effective diameter of the body housing 86 measured to the interior surface of the throat 176. Thus, the raised buttons 162–164 force the body housing 86 outwardly as they are inserted into their respective mouths such as mouth 173. As the bulb 82 with its collar 126 and the body housing 86 are rotated relative to each other, the raised buttons 162–164 come into alignment with their respective detent such as detent 178 and in turn effect a secure frictional and mechanical lock. Tolerances are selected so that the connection between the collar 126 and the body housing 86 is effectively watertight.

The buttons 162–164 and the locking keyways 168 and 169 are in effect a locking or connecting means to securely lock the bulb 82 to the body housing 86. The forces applied by squeezing the bulb 82 with water in the bulb urge the bulb 82 and the body housing 86 apart. Any suitable arrangement to effect a locking or connection that precludes separation during operation may be used as desired. A wide variety of locking screws, set screws, latches, catches and notches may be selected to effect a connection that cannot be separated under the forces present with the hand pumping action described herein.

Notably the collar 126 and the bulb 82, when assembled define a bulb opening 180. That is, the bulb 82 has an opening 180 through which fluid, and more specifically water, enters and leaves.

Figure 4:
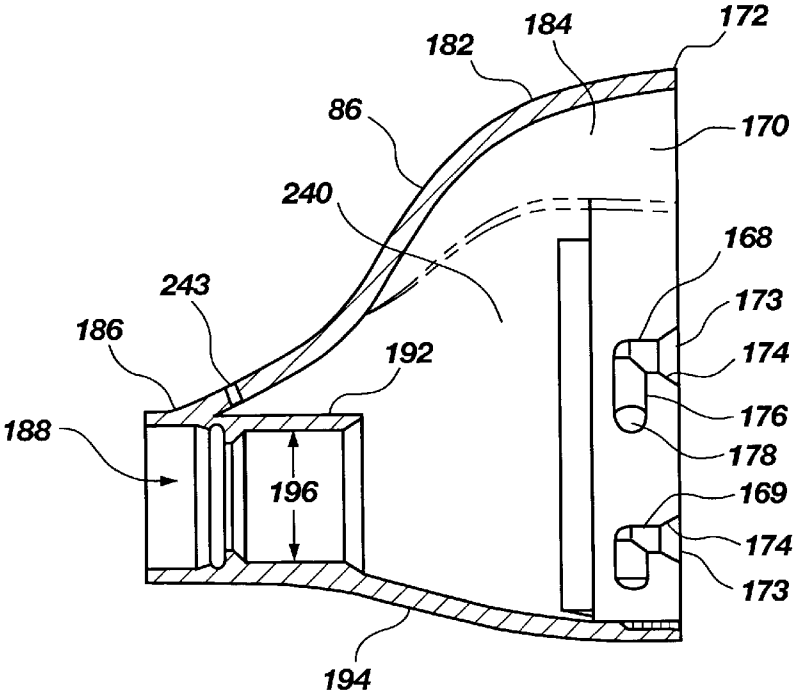
FIG. 4 is a side cross sectional view of a body housing for use with the portable debris remover of the present invention.
Figure 5:
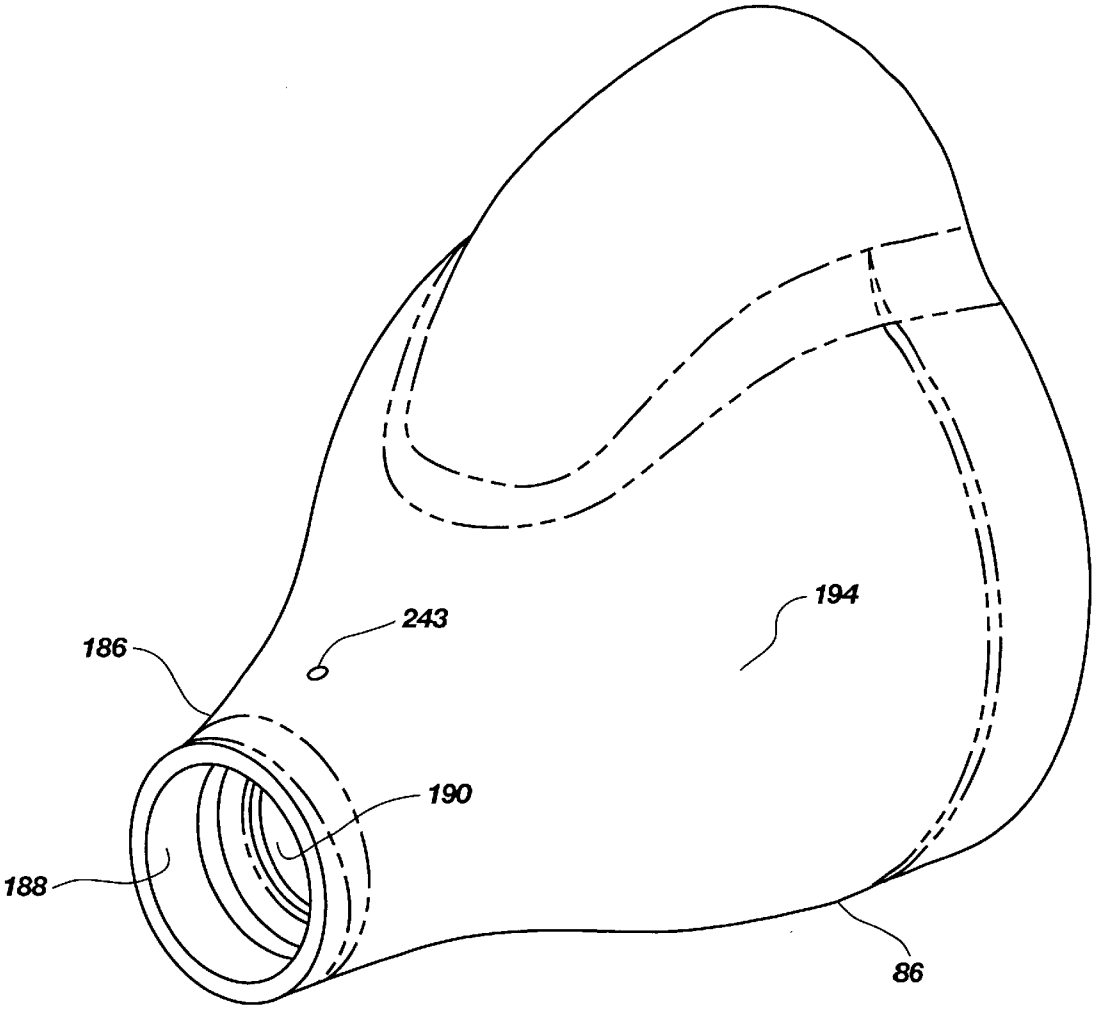
FIG. 5 is a perspective view of the body housing of FIG. 4.

The body 84 includes the body housing 86 and the body mechanism 88. The body housing 86 is shown in FIG. 5 to be generally cylindrical with a flute 182 which in combination with the collar 126 defines discharge port 184. The body housing 86 has a nose 186 with a cylindrical opening 188 sized to effect a snug frictional connection with the nozzle 89. The opening 188 is in communication with a channel 190 defined by a pipe section 192 unitarily formed with the wall 194 of the body housing 86 as best seen in FIG. 4. The pipe section 192 is cylindrical in form with an inside diameter 196 sized to effect a snug connection with the inlet member 198 of the body mechanism 88. As here shown, the inlet member 198 inserts into the pipe section 192. Alternately, the pipe section 192 could fit into the inlet member 198 (not shown). It is even contemplated that the inlet member 198 be sized to extend through the nose 186 and be formed to connect to the nozzle 89.

The inlet member 198 of the body mechanism 88 is also cylindrical in shape and has an outside diameter 200 selected to effect a snug frictional connection when inserted into the pipe section 192. A beveled front edge 202 facilitates assembly. The inlet member 198 extends in length 204 a distance selected so that the mouth 206 of the inlet member is positioned in or proximate to the bulb opening 180 when the portable debris remover 80 is fully assembled.

The mouth 206 of the inlet member 198 has a rim 208 that is transverse to the axis 210 of the inlet member 198. The rim 208 has a beveled surface 209 to form a knife edge 207 to fit against the valve flap 214 and effect a liquid seal while preventing debris from collecting and inhibiting the seal. A hinge base 212 is formed about the mouth 206 with recesses 218 (FIG. 9) formed on either side of the hinge base 212 to receive a valve flap 214. The recesses 218 are elongated with a length 219 selected to facilitate the movement of the valve flap 214 and to preclude the need for dimensional precision in the formation of the valve flap 214. The valve flap 214 has a flat surface 216 and is oriented so that the flat surface 216 is positioned against the knife edge 207 of the rim 208 to inhibit the movement of fluids and specifically water from the bulb interior 132 through the inlet member 198 when the bulb 82 is moved from the first position 129 to a compressed position 130.

The body mechanism 88 also has an outlet member 220. It is mounted to a disk member 222 and formed to extend there through. The disk member 222 is a circularly shaped solid member with an outside diameter 224 the same as or substantially the same as the outside diameter 158 of the collar 126 with the collar 126 and the disk member 222 being sized and positioned in the body housing 86 to form a water resistant seal between the inner face 226 of the collar 126 (FIG. 1) and an outer face 228 of the disk member 222.

The outlet member 220 has an outlet valve base 230 formed therewith also with recesses 231 on opposite sides to receive hinge pins of a valve flap 232. The valve flap 232 has a flat surface 234 which positions over the outlet member 220 toward the bulb opening 180.

The body mechanism 88, and more specifically the disk member 222, is shown in FIG. 1 inserted into the body housing 86. The disk member 222 has a circular portion 223 that forms what may be viewed as a rim with an angled contact surface 238. The angled contact surface 238 contacts the interior surface 240 of the body housing 86 to effect a snug seal and inhibit water movement therepast. Posts 221 A and 221 B are shown and are associated with the molds used in fabrication. The posts also support the filter 244 and more specifically the screen 248 as liquid is being urged outwardly from the bulb 82 into the discharge chamber 242.

As seen in FIG. 1, the disk member 222 of the body mechanism 88 and the flute 182 define the discharge chamber 242 into which the water or other liquid is discharged upon passage from the outlet member 220. The discharge chamber 242 is in direct communication with the discharge port 184 which is oriented by flute 182 to direct the discharge away from the area of the nozzle 89 and in turn reduce or minimize any turbulence that may thereby be induced in the liquid in the vicinity of the nozzle 89. Turbulence may cause debris on an underwater or bottom surface 94 to become suspended in the water so that removal would be less efficient.

It may also be noted that an orifice 243 is formed through the side wall of the body housing 86 to communicate between the exterior of the body housing and the discharge chamber. The orifice 243 is easily formed as a circular aperture with a diameter of about 1 millimeter. The orifice may be sized from about 0.5 millimeters to about 2 millimeters so that in use, the water or other liquid exiting the debris remover 80 does not exit in any notable quantity or with any notable force or flow. Rather the water or other liquid exits through the discharge port 184. However, in periods of non-use, the debris remover is typically taken out of the water for storage. When suspended or hung by the eye 146, the water or other liquid may drain out the outlet 220 and through the orifice 243.

Figures 9, 10:
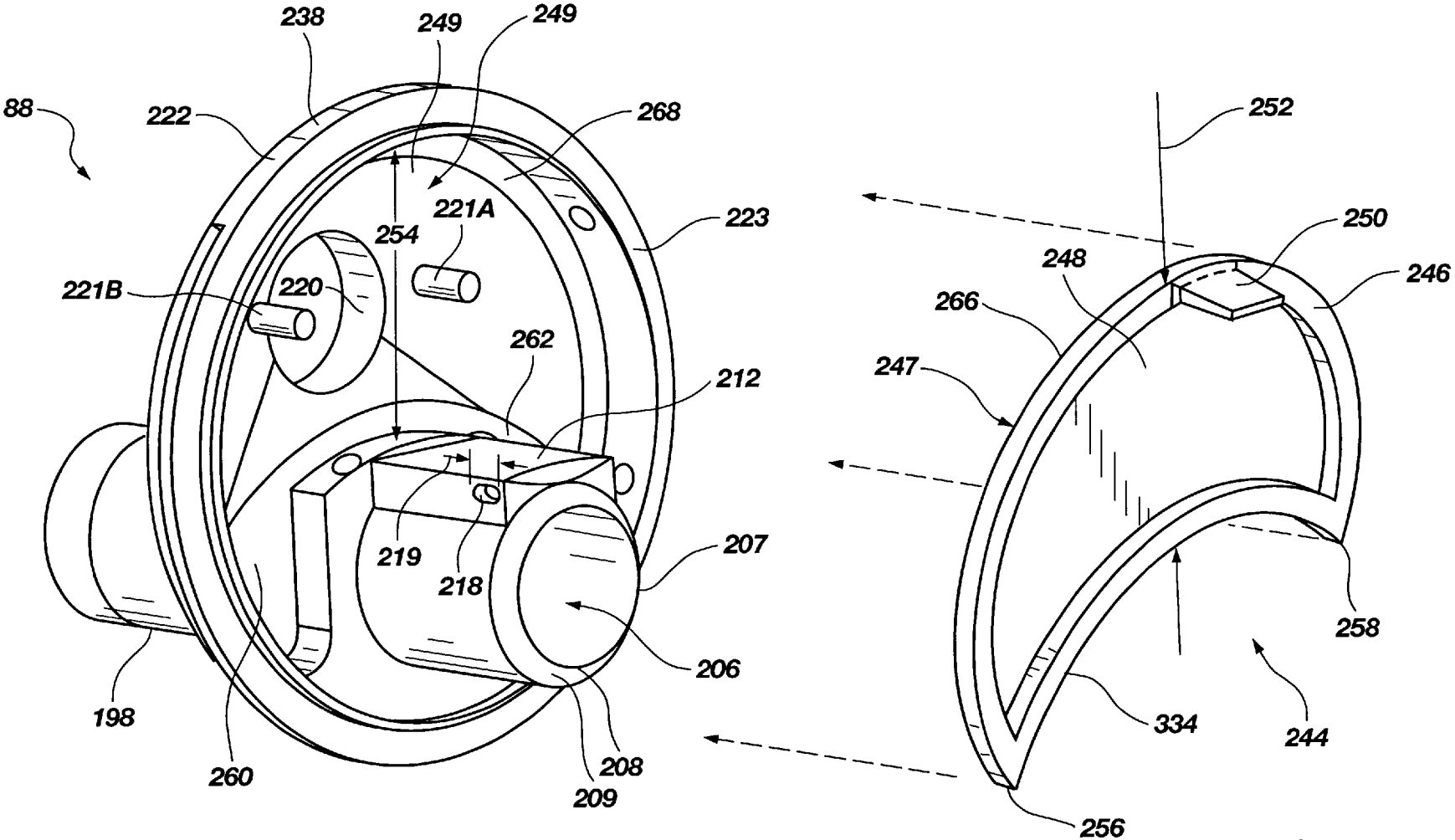
FIG. 9 is a rear perspective view of the body mechanism of FIG. 6.
FIG. 10 is a perspective view of a screen of the type for use with the portable debris remover of the present invention.

As better seen in FIGS. 9 and 10, a filter 244 is provided for positioning in a filter section 249 to inhibit the movement of debris into the outlet member 220. The filter 244 shown has a frame 246 made of a suitable material such as plastic and a screen 248 selected to have openings to pass water but to retain or block movement of the small debris therethrough. The screen frame 246 has a tab 250 so the user has structure to grasp for installation and removal. As shown, the frame 246 is in the shape of a crescent and sized with a height 252 selected to fit snugly into the filter section 249 which has a corresponding height 254. The screen frame 246 is sized and shaped so that its tips 256 and 258 register with corresponding sealing surfaces 260 and 262 of the disk member 222. Thus, upon installation of the filter 244, the upper portion 266 of the frame 246 registers snugly with the inner surface 268 of the disk member 222 to effect a seal to inhibit the movement of small debris past the filter 244. That is, the frame 246 is generally planner so that the frame 246 presents a flat surface 247 to abut the inner surface 268 as well as portions of the sealing surfaces 260 and 262.

Figure 15:
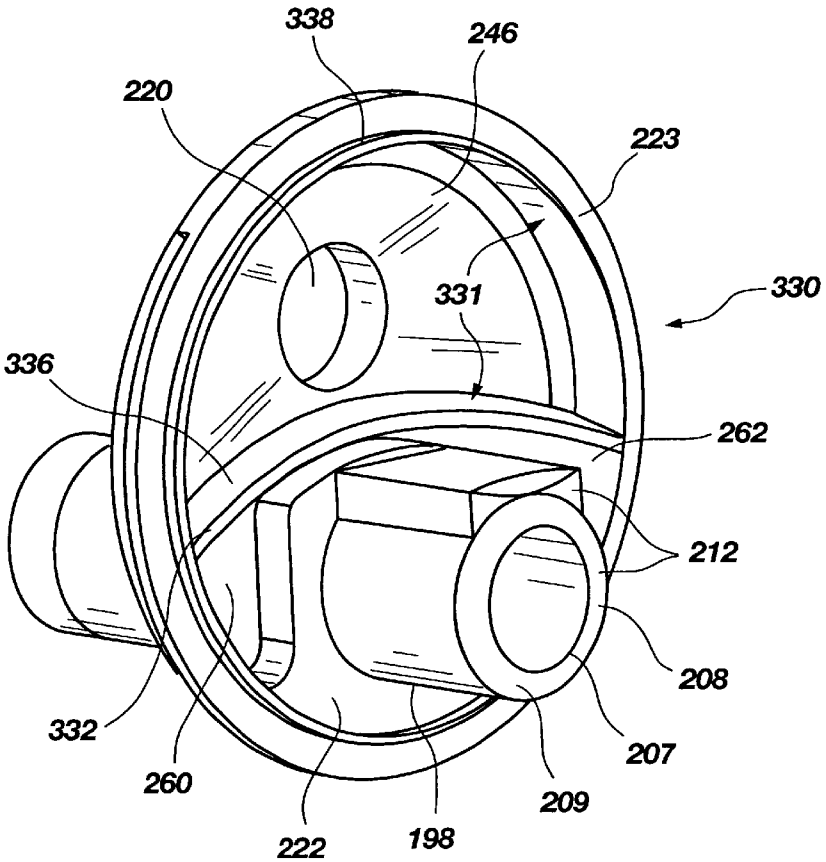
FIG. 15 is a partial perspective view of a body mechanism for use with the present invention.
Figure 16:
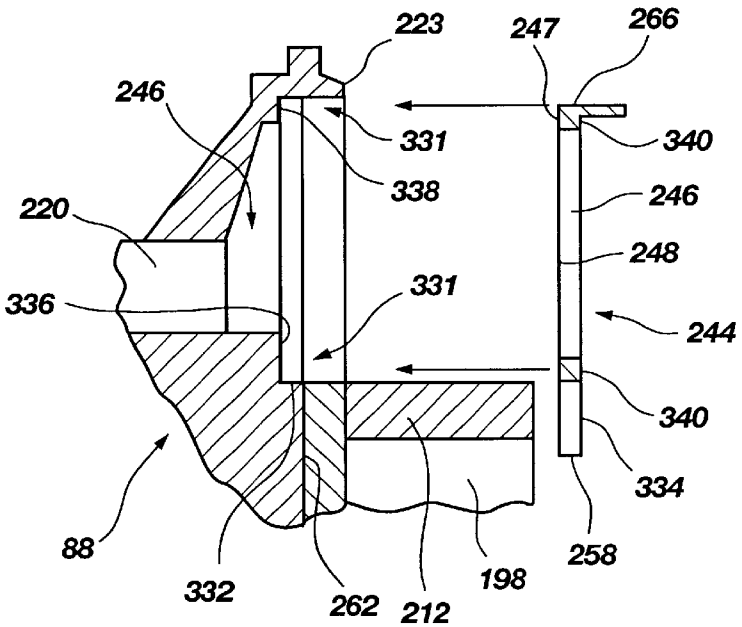
FIG. 16 is a partial side cross sectional view of a body mechanism of FIG. 15 and a filter.

A preferred arrangement is shown in partial perspective in FIG. 15 and in partial cross section in FIG. 16. Specifically, a body mechanism 330 is shown which is virtually the same as the body mechanism 88. Similar parts in body mechanisms 88 and 330 are numbered the same. However, body mechanism 330 differs from body mechanism 88 because body mechanism 330 is formed to have a sealing recess 331 to accept the filter 244. More specifically, the body mechanism 330 has a lip 332 formed in the surfaces 260 and 262. The lip 332 is sized and shaped to correspond with the shape of the lower frame member 334 (FIG. 10) so that the lower frame member 334 of the filter 244 will snugly and sealingly fit with the sealing surface 260 against the lip 332 and with the inner surface 247 flush against the surface 336 that extends arcuately over the inlet 198 and flush against the surface 338 that extends around the disc 222. Thus, the filter 244 fits into the recess 331 shaped to snugly receive the filter 244. The inner surface 247 does not rest on top of surfaces 260 and 262 of body mechanism 88 as illustrated in FIGS. 9 and 10. Rather, the filter 244 fits so that the outer surface 340 is substantially flush with surfaces 260 and 262 when the filter is installed in the recess 331 with the inner surface 247 flush against surfaces 336 and 338. The arrangement of FIGS. 15 and 16 is preferred because it is believed that better seal is effected to reduce or avoid leakage past the filter 244.

Notably, debris that collects on the screen 248 may fall downward (with the portable debris remover oriented as shown in FIG. 1) into the bulb 82 for collection and eventual removal. More specifically with the axis 98 oriented in use as hereinbefore discussed, the debris is expected to collect proximate the lip 152 of the bulb 82.

The filter 244 is shown to be generally planar. That is, it extends between the frame 246 and is flat or nearly so within normal manufacturing tolerances. After a period of use, it may not be flat. In other words, a screen 248 may distend over time and become dished or disfigured and no longer be flat. However, it may be made to be convex or concave if desired.

The filter 244 is shown to be formed to be generally planar and installed to be transverse to the axis 98 of the debris remover 80 and axis 210 of the inlet member 198 and the axis 243 of the outlet member 220. As so oriented, in operation, the debris 245 on the screen 248 is under the force of gravity so that as it is backwashed away from the screen, it precipitates downward and away from the screen 248 to provide the debris remover with a type of self cleaning function and capability.

Figure 2:
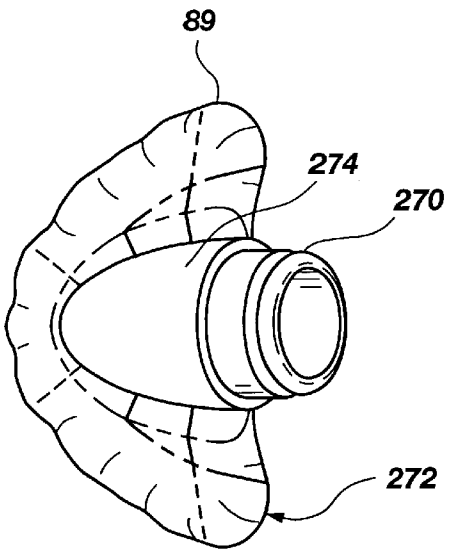
FIG. 2 is a top view of a nozzle for use with the portable debris remover of the present invention.
Figure 3:
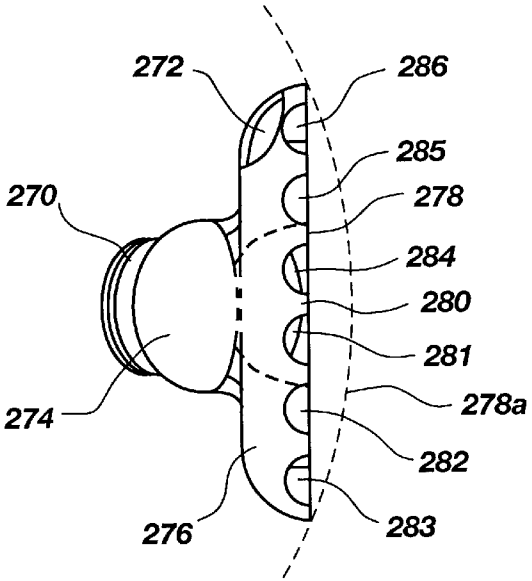
FIG. 3 is a front view of the nozzle of FIG. 2.

Referring now to FIGS. 1–3, the nozzle 89 is shown with a connector 270 sized to effect a frictional connection with the opening 188 in the body housing 86. The connector 270 is in communication with the nozzle chamber 272 through throat 274. The nozzle 89 has a wall 276 with a bottom edge 278 that is flat and that is planar so that it will be in contact with a flat or planar surface such as underwater or bottom surface 94. The wall 276 may be said to have a first wall portion or front edge 280 that has a plurality of ports 281–286 that are formed in the edge 280 so that water may enter. The effective area of the ports 281–286 is selected so that the water will proceed into the nozzle chamber 272 at a velocity that disturbs the debris 290 on the surface and thereby entrains it in the water. The speed or velocity of the water or other liquid is such that the water or other liquid with the debris 290 moves rapidly so that the debris does not become mixed or diluted proximate the front edge 280.

A second wall portion or rear edge 288 is provided that has no openings. Thus, the nozzle 89 may be moved along a flat surface such as underwater or bottom surface 94 with dirt or grit 290 moving through the openings 281–286 and with water or other liquid also moving through the openings. As water or other liquid is urged through the openings 281–286, the dirt or grit becomes entrained and moves with the water or other liquid through the throat 274 and then inwardly through the connector 270 and the inlet member 198 into the bulb opening 180.

The nozzle 89 may have different sizes and shapes for different spas, hot tubs and pools. For example, the bottom edge 278 may be rounded or arcuate 278*a* to proximate a rounded surface rather than a flat surface 94. Therefore, the user may have one or more nozzles 89 that can be interchanged to operate the debris remover 80 over surfaces of different form or shape. The nozzle 89 may be formed of any deformable material so that the user may press on the debris remover to urge the nozzle 89 to be in mechanical alignment or to be in substantial conformity with the surface 94 to enhance operation. That is, to be in substantial conformity, the nozzle 89 must be close enough to cause the debris entrained in the fluid to move into the nozzle for further processing in the debris remover. Alternately, nozzles of widely different sizes and shapes may be available for the user to select the most suitable for the surface 94 to be cleaned.

The throat 274 and the connector 270 of the nozzle 89 extend away at an angle when the bottom edge 278 is positioned on a surface such as flat underwater or bottom surface 94. That is, when the bottom edge 278 and the flat surface 94 are co-planar, the throat 274 and in turn the portable debris remover extends away at an angle of less than 90 degrees and more specifically at an angle between about 25 degrees and 50 degrees. The most preferred angle is about 37.5 degrees as measured between the flat surface such as the underwater or bottom surface 94 and the axis 210 of the inlet member 198. As so oriented, the body housing 86 and in turn the body mechanism 88 as well as the bulb 82 are similarly oriented relative to the surface 94. The angle 199 of 37.5 degrees has been found to best accommodate the orientation of the wrist of a user for moving the debris remover 80 along a surface that is being cleaned by the hand of a user.

Figure 7:
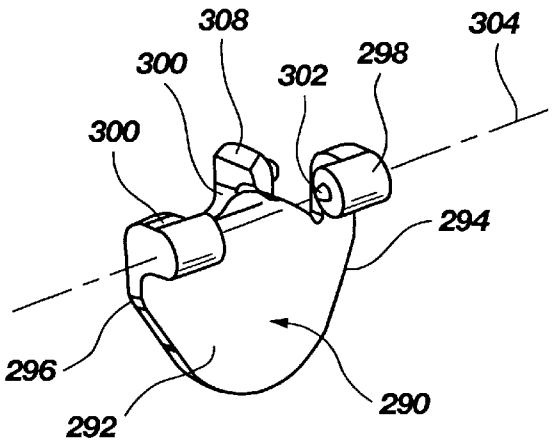
FIG. 7 is a perspective view of a valve flap for use with the inlet valve and the outlet valve of the portable debris remover of the present invention.
Figure 8:
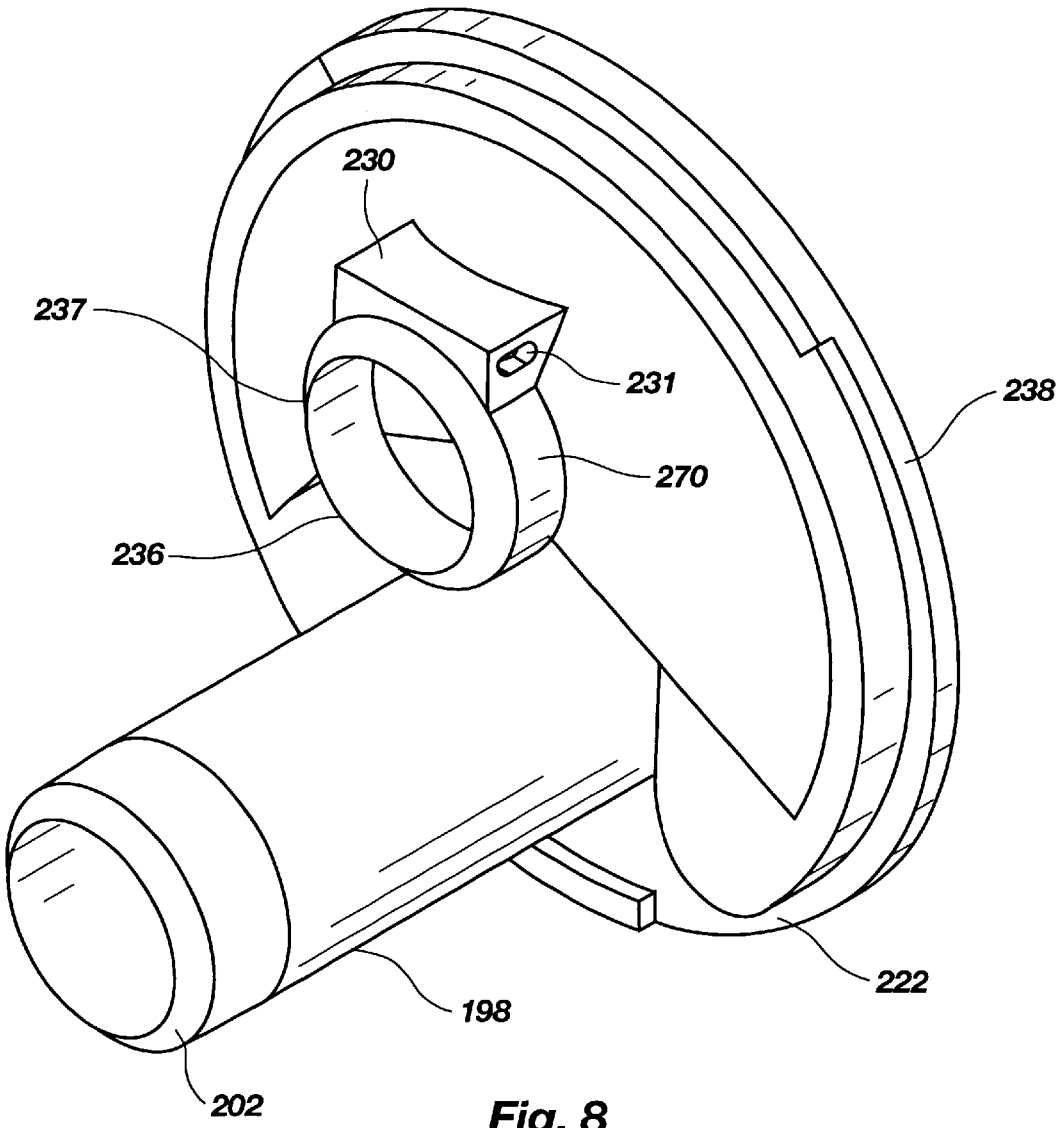
FIG. 8 is a front perspective view of the body mechanism of FIG. 6.

FIG. 7 depicts in perspective a valve flap 290 that may be used as the valve flap 214 and the valve flap 232. That is, the same sized valve flap is used for both the inlet check valve 213 and the outlet check valve 229. The valve flap 290 has a flat surface 292 for contact with a corresponding sealing surface such as rim 208 and rim 236. Of course, it must be understood that the valve flap 290 only has a portion to contact the knife edges 207 and 237. The rest of the valve flap 290 need not be flat but may be of any configuration desired.

The valve flap 290 includes a left arm 294 and a right arm 296. Each arm has a shoulder 298 and 300 formed with a hinge pin 302. The hinge pin for the shoulder 300 is not shown. The hinge pins such as hinge pin 302 are on an axis 304 and are sized to fit into the recesses formed in the valve base 230 such as recess 231 as well as recesses formed in the valve base 212 for the inlet check valve such as recess 218. The recesses are elongated 219 so that dimensional precision is not required and so that the pins may move axially 98 to reduce the chance the valve flap 290 will be jammed and no longer operate because a small piece of the debris lodges in such a way as to cause either the inlet check valve 212 or the outlet check valve 229 to jam in a fixed position.

Valve flap 290 is preferably unitarily formed out of a suitable plastic so that the arms 294 and 296 elastically flex enough so that the hinge pins such as hinge pin 202 snap into the appropriate recesses to rotate about the axis 304. The valve flap 290 also has a stop arm 306 formed to extend away from the flat surface 292 with a stop 308 positioned at the distal end of the stop arm 306 to contact the respective valve base 212 and 230. Preferably the plastic is selected to have a specific gravity greater than the fluid in which the debris remover is to be used. Thus, for spas, hot tubs, pools and the like, the valve flap is made of a plastic with a specific gravity from about 1.1 to about 1.5 and preferably about 1.2. Delrin™ plastic has been found to be particularly suitable. With a specific gravity selected to be from about 10% to about 50% greater than the specific gravity of the fluid to pass through the debris remover, the valve flap 290 is heavier than the fluid passing through the debris remover. When oriented at the desired angle 199, the inlet valve flap 214 will not float but rather close under the force of gravity. At the same time, the valve flap 214 is not so heavy that the operation of the bulb 82 is unable to cause fluid flow through the inlet 198 sufficient for effective operation of the debris remover. In turn, the inlet check valve 213 does not require complicated springs or other structure to effect closure.

The valve flap 290, as so constructed, is suitable for the outlet check valve 229. The specific gravity between 10% and 50% of the fluid in which the debris remover is to operate allows the fluid from the chamber 242 to close the outlet check valve 229 as the bulb 82 moves from the compressed toward the uncompressed state. That is, the specific gravity of the valve flap 290 is selected between 1.1 and 1.5 and preferably about 1.2 so that the valve flap 232 of outlet check valve 229 stays open longer than for a valve flap 232 with a lower specific gravity and yet not too long so that the backflush of the filter 244 is effectuated and effective.

Figure 6:
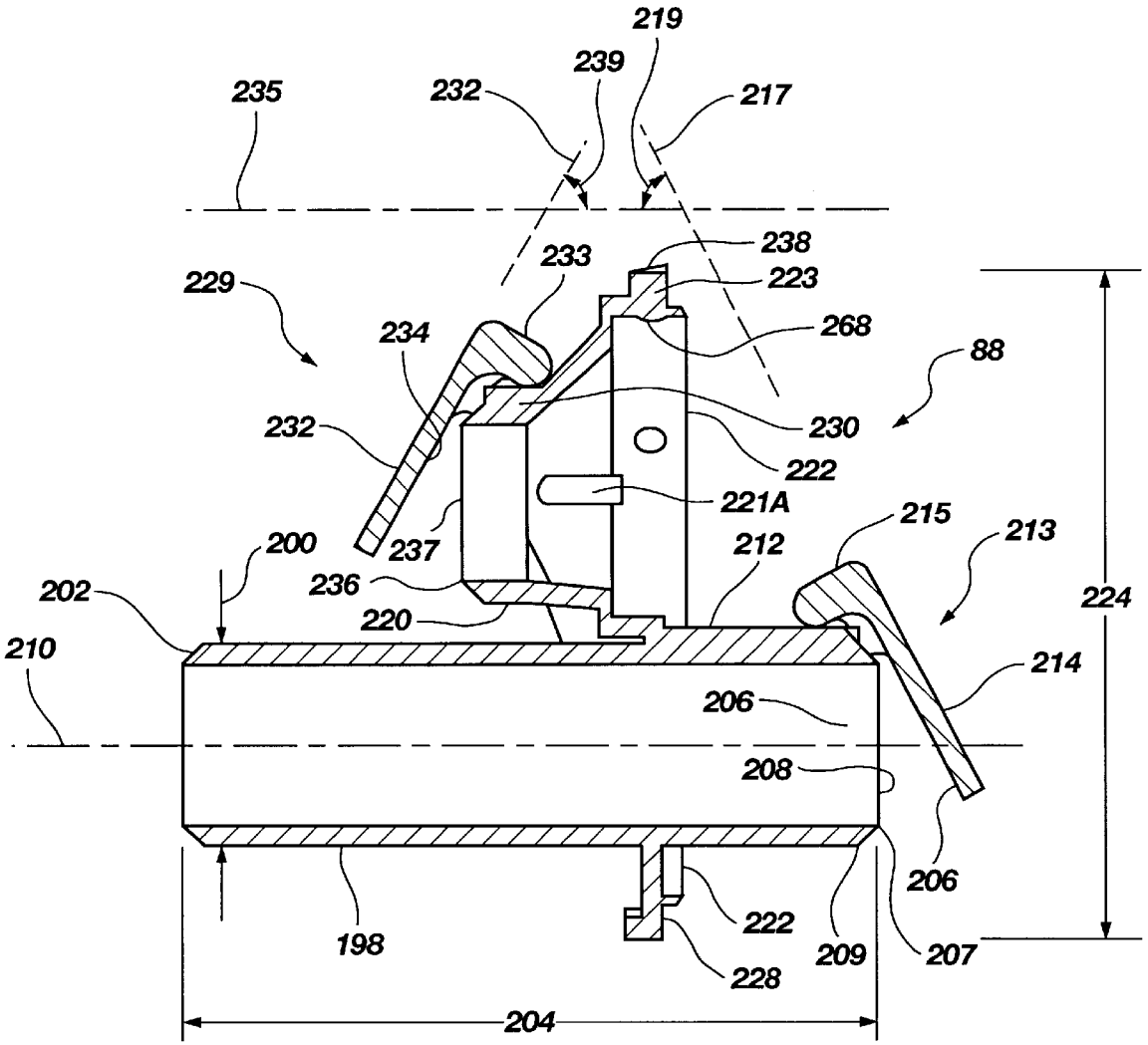
FIG. 6 is a cross sectional view of a body mechanism for use with the body housing of FIG. 5.

As better seen in FIG. 6, the stop 215 of valve flap 214 and the stop 233 of valve flap 232 contact their respective valve bases 212 and 230 to retain the valve discs 214 and 232 at an angle. As shown in FIG. 6, a line 235 parallel with the axis 210 intersects planes 217 and 237 which extend from the flat surface 234 and from the flat surface 216. The angle 219 and the angle 239 at the intersection of the planes 217 and 237 with the line 235 are here shown to be about 60 degrees. The angles 219 and 239 need not be the same and may be from about 30 degrees to about 70 degrees. The angles 219 and 239 are selected to allow adequate flow of water or other liquid through the respective inlet member 198 and outlet member 220 while at the same time being oriented so that movement of fluid such as water toward check valve 213 and check valve 229 produces a net hydraulic force to close the valve. Thus water in the bulb 82, when urged by user moving the bulb 82 toward and into a compressed position 130, moves toward the check valve 213 and applies a pressure to the valve flap 214 to urge it toward the closed position. The stop 215 is sized so that the valve flap 214 and the flat surface 216 is in a stream of water or other liquid that starts to proceed toward the inlet member 198 as the bulb 82 is squeezed. Indeed, with a specific gravity in excess of 1.0, the valve flap 214 will start to swing closed and may be fully closed before there is flow out the inlet 198. Thus, a spring or other device to force the valve flap 214 of the check valve 213 to a closed position is not required.

For the outlet member 220, the valve flap 232 similarly is oriented at the angle 239 established by the shape and orientation of the stop 233. As the bulb 82 is manipulated so that it moves from the compressed position 130 to the at-rest position 129, water in the discharge chamber 242 first moves toward the valve flap 232 to urge it closed. Inasmuch as the valve flap 232 is open as the bulb 82 begins to move from the compressed 130 to the at-rest 129 positions, some water or other liquid proceeds from the discharge chamber 242 through the outlet member 220 into the bulb opening 180 before the valve flap 232 closes. Thus, the filter screen 244 is back washed and the debris collected on the screen 248 is urged away and allowed to fall into the interior proximate the lip 152 of the bulb 82. Therefore in use, the filter screen 244 is back washed on every pumping cycle and should not rapidly clog or block forcing the user to stop and clean the filter screen 244. The backwashing feature also allows the use of relatively small filter 244 with a small screen 248 that can be used for long periods without replacement.

To operate the debris remover 80 of FIG. 1, the bulb 82 is grasped by the user and moved or placed under the water and on the bottom or other suitable surface of a pool. spa, hot tub or the like. In the embodiment illustrated, the debris remover 80 is positioned at an angle 199 of about 37.5 degrees from the plane of the surface upon which the debris remover 80 is being manipulated or operated. Upon placement on the surface, the user begins to move the nozzle along the surface and manipulate the bulb between the at-rest position 129 and the compressed position 130 while moving the debris remover along the surface 94 being cleaned (e.g., 3–6 inches of movement along the surface). If the surface is arcuate, a nozzle having a rounded bottom surface may be used. Alternately, a nozzle may be used which is deformable and that can be pressed to conform to the surface to be cleaned.

In use, the debris remover 80 may be fully submerged under the water or other liquid or only partially submerged. That is, so long as the nozzle 89 is substantially under the surface of the fluid, the debris remover may be deemed to be under water or other liquid and fully operable. Thus, the debris remover 80 will operate in both liquids that are 2–3 feet deep as well as in shallow water (e.g., about 2–4 inches of water).

Figure 17:
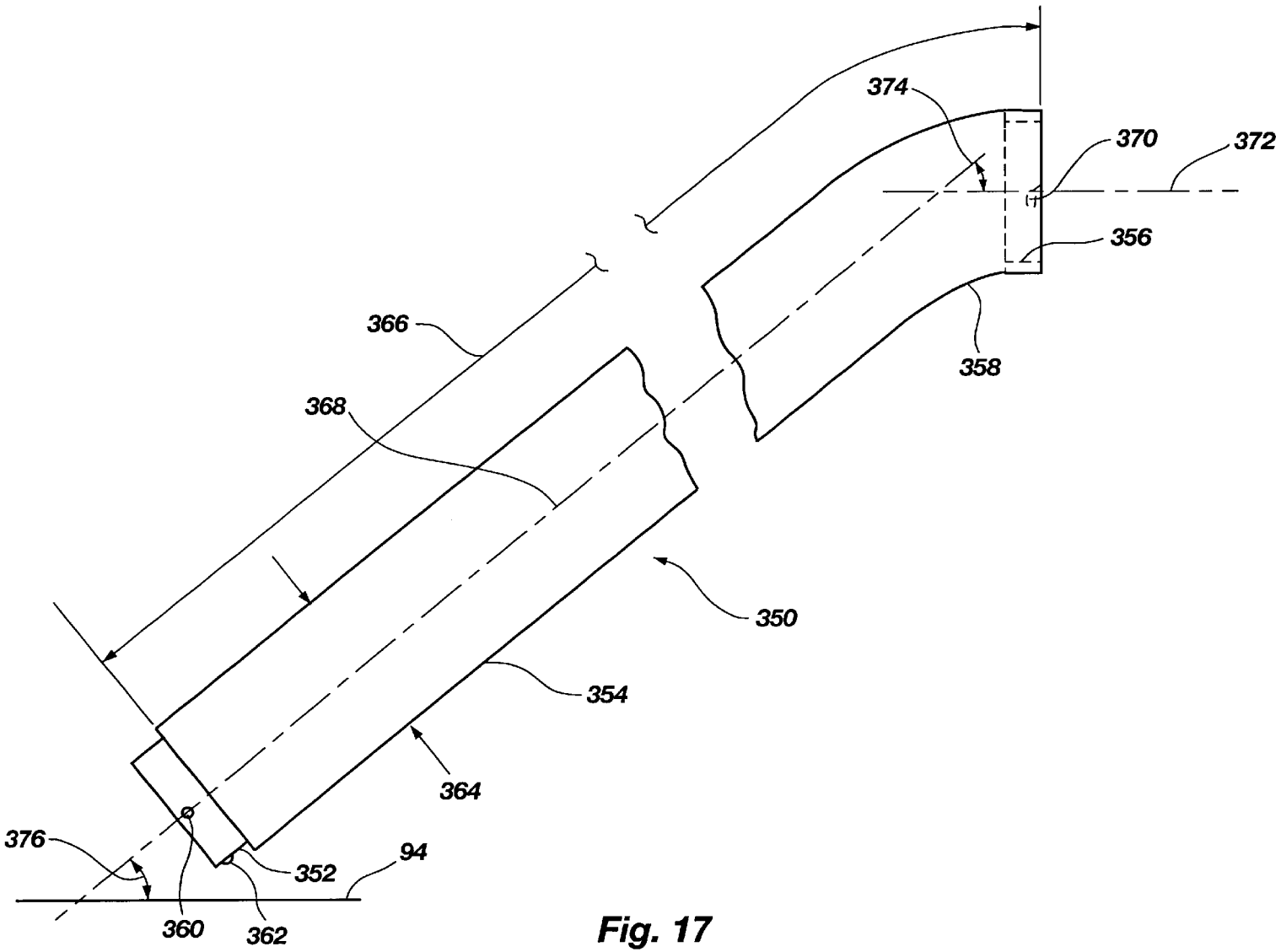
FIG. 17 is a partial side view of an extension accessory for use with the portable debris remover of the present invention.

With liquids in containers that are deep, some users may find it desirable to have the bulb 82 at or near the surface 90. That is, the user may not be able to reach the bottom surface 94 with the debris remover 80 without submerging the user's head. In other words, the user's arms may be too short or the liquid depth to great. In such a situation, the user may use an extension such as the extension 350 illustrated in FIG. 17. As shown, it has a collar 352 connected to or formed with a tube 354. The tube 354 has a connector 356 at its other or upper end 358 configured to receive a bulb like the bulb 82.

The collar 352 is sized and shaped comparable to bulb collar 126 so that it will fit into the body housing 194 the same as the bulb collar 126. The collar 352 has a plurality of raised buttons such as buttons 360 and 362 positioned and configured to register with the corresponding keyways such as locking keyways 168 and 169 in the body housing 194. In turn the collar 352 can be locked together with the body housing 194.

The collar 352 is either connected to or formed to be part of the tube 354. That is, the collar 352 may be a separate structure and may even be identical to collar 126. If a separate structure, the tube 354 is formed with means to provide for a substantially watertight connection between the tube 354 and the collar 352. In either case, liquids and air can readily move between the tube 354 and the body housing 194.

The tube 354 is shown to be hollow and cylindrical with a diameter 364 selected to provide for the ready communication of liquid and gas or air therethrough to and from the body housing 194. The tube 354 is sized to have a length 366 which can vary from a few inches to several feet but is preferably from about 9 inches to about 24 inches. It may have several sections or separate lengths that have typical mechanical connections. That is separate sections can be joined by any means preferred including a threaded connection, a friction connection, and any other type that does not appreciably reduce the ability to communicate liquid and gas therethrough Further, the tube 354 may have any other desired cross sectional shape including, by way of example and not limitation, rectangular and octagonal shapes. Thus the tube 354 may be of any suitable length and any desired shape in cross section. It may also be made in several lengths or sections. The tube 354 is also shown to be straight extending along axis 368. Even though straight would appear to be preferable, the tube 354 could have other shapes or configurations.

At the upper end 358 of the tube 354, connector 356 is either unitarily formed with the tube 352 or a separate insert that attaches or connects into the tube 352. The connector 356 is configured to snugly receive connector 126 so that a bulb like bulb 82 can be attached and operated by the user as earlier described. That is, the connector 356 has keyways or locking keys such as keyway 370 to register with buttons on the collar 126 to effect a secure connection substantially the same as when the bulb 82 connects to body housing 194.

The extension 350 may be straight but is here shown with its upper end 358 formed to extend along axis 372. Axis 372 intersects axis 368 at an angle 374 that may vary from nearly zero degrees to about 45 degrees and is preferably about 15 degrees. The extension 350 itself connects to the body housing 194 which is positioned so that the debris remover 80 is operated at angle 199 relative to the surface 94.

Although the extension 350 is shown to have the upper end 358 oriented at the angle 374, it should be understood that the extension 350 may be essentially straight or in any other desired configuration so that it may be operated at or proximate the surface of the liquid to be cleaned.

At the end of the cleaning operation, the user may remove the debris remover 80 from under water or other liquid and position it whereby the bulb 82 drains. When desired, the user may disassemble the bulb 82 and bulb collar 126 from the body housing 86. The bulb 82 may then be washed out to remove any grit or the like. Similarly, the filter 244 may be removed and washed off to remove any residual dirt. Indeed the body 84 may be washed out to remove any grit or dirt. Thereafter, the unit 80 may be assembled and returned to service.

Those skilled in the art will recognize that other variations or modifications are available without departing from the spirit of the inventions herein disclosed and are within the scope of the teachings and herein. The embodiments described herein are not intended to limit the scope of the claims which themselves set forth those features which the applicant presently regards as essential to the invention.

What is claimed is:

1. A portable debris remover for use under the surface of a volume of liquid within a structure having at least one submerged surface upon which debris from said liquid collects, said portable debris remover comprising:

a body for positioning under the surface of the volume of liquid, said body having an inlet for positioning relative to said submerged surface and configured to receive liquid with debris from said submerged surface entrained therein, said body having an outlet configured to discharge liquid without said debris to said volume of liquid, said body having an axis and said body being positioned away from said submerged surface at an angle that is less than ninety degrees;

a bulb sized for grasping with the hand and for positioning under the surface of the volume of liquid, said bulb having a bulb opening configured to connect to said body to be in communication with said inlet and said outlet, said bulb being formed of a squeezable material operable by the hand of a user between an at-rest position in which said bulb defines a first volume and a compressed position in which said bulb defines a second volume smaller than said first volume;

an inlet check valve positioned relative to said inlet and operable between an open position and a closed position, said inlet check valve moving to the open position when liquid flows into said bulb through said bulb opening upon movement of said bulb from said compressed position to said at-rest position, said inlet check valve moving toward the closed position when liquid flows out of said bulb through said bulb opening upon movement of said bulb from said at-rest position to said compressed position;

an outlet check valve positioned relative to said outlet and operable between an open position and a closed position, said outlet check valve moving to its open position when liquid flows out of said bulb through said bulb opening upon movement of said bulb from said at-rest position to said compressed position, and said outlet check valve moving toward the closed position after liquid flows into said bulb through said bulb opening upon movement of said bulb from said compressed position to said at-rest position;

a screen positioned proximate said outlet to remove debris from said liquid when passing through said outlet; and a nozzle for attachment to said body, said nozzle being formed with an undersurface for contact with and movement over said submerged surface of said structure and said nozzle being formed to entrain debris in liquid urged into said inlet upon movement of said bulb from said compressed position to said at-rest position, said nozzle having a front with ports formed to receive said liquid with said debris entrained there through and a rear spaced from said front and formed to urge debris toward said front upon movement of said nozzle along said submerged surface.

2. The portable debris remover of claim 1 wherein said submerged surface is flat, wherein said undersurface of said nozzle is flat, and wherein said angle between said axis and said submerged surface, with said nozzle positioned with its undersurface flatly on said submerged surface, is from about twenty degrees to about fifty degrees.

3. The portable debris remover of claim 2 wherein said angle is from about thirty five degrees to about forty degrees.

4. The portable debris remover of claim 1 wherein said outlet is positioned above said inlet and wherein said screen is positioned proximate said outlet to inhibit the flow of debris there through with liquid flowing out said outlet and to wash debris therefrom with liquid flowing from said outlet toward said bulb.

5. The portable debris remover of claim 4 wherein the screen is generally planar and positioned generally transverse to said axis.

6. The portable debris remover of claim 5 wherein said bulb is connected to said body and sized and shaped to collect debris falling from said screen.

7. The portable debris remover of claim 1 wherein said nozzle, said body, said bulb, said inlet check valve, said outlet check valve and said screen are formed of materials and sized collectively to have positive buoyancy with said bulb defining said first volume which is full of liquid.

8. The portable debris remover of claim 1 wherein said body is formed to have an outlet chamber with a sidewall, and wherein an aperture is formed in the said sidewall of said outlet chamber to communicate between the exterior of said portable debris remover and said outlet chamber, said aperture being sized to restrict the flow of liquid therethrough.

9. The portable debris remover of claim 1 further including an extension connectable between said body and said bulb, said extension being sized in length to position said bulb at a desired position relative to the surface of the liquid.

10. A portable debris remover for use under the surface of a volume of liquid within a structure having at least one submerged surface upon which debris from said liquid collects, said portable debris remover comprising:

a body positionable under the surface of the volume of liquid, said body having an inlet for positioning relative to a said submerged surface and configured to receive liquid with debris from said submerged surface entrained therein, said body having an outlet configured to discharge liquid to said volume of liquid, said body having an axis and said body being positioned relative to said submerged surface at an angle that is less than ninety degrees;

a bulb positionable under the surface of the volume of liquid, said bulb having a bulb opening configured to connect to said body with said inlet and said outlet in said bulb opening, said bulb being formed of a squeezable material operable by the hand of user between an at-rest position in which said bulb defines a first volume and a compressed position in which said bulb defines a second volume which is less than said first volume;

an inlet check valve positioned relative to said inlet and operable between an open position and a closed position, said inlet check valve being in the open position when liquid flows into said bulb through said bulb opening upon movement of said bulb from said compressed position to said at-rest position, said inlet check valve being in the closed position when liquid flows out of said bulb through said bulb opening upon movement of said bulb from said at-rest position to said compressed position;

an outlet check valve positioned relative to said outlet and operable between an open position and a closed position, said outlet check valve being in the open position when liquid flows out of said bulb through said bulb opening upon movement of said bulb from said at-rest position to said compressed position, and said outlet check valve being configured to move toward the closed position upon the urging of liquid flowing into the outlet toward said bulb upon movement of said bulb from said compressed position to said at-rest position in the outlet; and a screen positioned proximate said outlet to remove debris from said liquid before passing through said outlet, said debris being urged away from said screen by said liquid flowing through said outlet toward said bulb as said bulb moves from said compressed position toward said at-rest position; and a nozzle for attachment to said body, said nozzle having an exterior wall defining a nozzle chamber, said exterior wall having a bottom surface for contact with said submerged surface, a first wall portion with ports formed to receive said liquid with said debris entrained there through, and a second wall portion spaced from said first wall portion and formed to urge debris into said nozzle chamber upon movement of said bottom surface along said submerged surface.

11. The portable debris remover of claim 10 wherein said submerged surface is flat, wherein said bottom surface of said nozzle is flat, and wherein said body is formed to be positioned at an angle from about twenty degrees to about fifty degrees between said axis and said surface with said nozzle positioned with its bottom surface substantially in alignment with said submerged surface.

12. The portable debris remover of claim 11 wherein said outlet is positioned above said inlet and wherein said screen is positioned proximate said outlet to inhibit the flow of debris there through with liquid flowing out said outlet and to urge debris therefrom with liquid flowing from said outlet toward said bulb.

13. The portable debris remover of claim 12 wherein the screen is generally planar and positioned generally transverse to said axis, and wherein said bulb is connected to said body and sized and shaped to collect debris urged away from said screen.

14. The portable debris remover of claim 10 wherein said inlet check valve has a valve flap constructed of material that has a specific gravity from about 1.1 to about 1.5.

15. The portable debris remover of claim 10 wherein said inlet check valve has a valve flap constructed of material that has a specific gravity of about 1.2.

16. The portable debris remover of claim 10 wherein said inlet check valve has a valve flap and a rim with a knife edge to contact said valve flap.

17. The portable debris remover of claim 16 wherein said outlet check valve has a valve flap and a rim with a knife edge to contact said valve flap.

18. The portable debris remover of claim 17 wherein said inlet check valve and said outlet check valve each have a valve flap formed with pins and configured to rotate about said pins, and wherein said inlet check valve and said outlet check valve each have a base with elongated slots formed therein to receive said pins.

19. The portable debris remover of claim 10 which said outlet check valve is configured to close after sufficient liquid flows backward through said outlet to backflush said screen as said bulb is operated from said compressed condition toward said at-rest position.

20. The portable debris remover of claim 10 further including an extension for connection between said body and said bulb, said extension being sized in length to position said bulb proximate the surface of liquid with said nozzle positioned proximate said submerged surface.

21. A portable debris remover for use under the surface of a volume of liquid within a structure having at least one submerged surface upon which debris from said liquid collects, said portable debris remover comprising:

a body positionable under the surface of the volume of liquid, said body having an inlet for receiving liquid from said volume of liquid, said body having an axis positioned at an angle from about 20 degrees to about 50 degrees between said axis and said submerged surface and configured to receive liquid with debris from said submerged surface entrained therein and an outlet configured to discharge liquid to said volume of liquid;

a bulb positionable under the surface of the volume of liquid, said bulb having a bulb opening configured to connect to said body with said inlet and said outlet in said bulb opening, said bulb having a sidewall formed of a squeezable material, said sidewall being operable by the hand of user between an at-rest position in which said bulb defines a first volume and a compressed position in which said bulb defines a second volume that is reduced in size from said first volume;

an inlet check valve positioned relative to said inlet and operable between an open position and a closed position, said inlet check valve being in the open position when liquid flows into said bulb through said bulb opening upon movement of said bulb from said compressed position to said at-rest position, said inlet check valve being in the closed position when liquid flows out of said bulb through said bulb opening upon movement of said bulb from said at-rest position to said compressed position;

an outlet check valve positioned relative to said outlet and operable between an open position and a closed position, said outlet check valve being in the open position when liquid flows out of said bulb through said bulb opening upon movement of said bulb from said at-rest position to said compressed position, and said outlet check valve being in the closed position as liquid starts to flow into said bulb through said bulb opening upon movement of said bulb from said compressed position to said at-rest position; and a screen positioned proximate said outlet to remove debris from said liquid before passing through said outlet; and a nozzle for attachment to said body, said nozzle having an exterior wall defining a nozzle chamber, said nozzle wall having a bottom surface for contact with said submerged surface, and said nozzle wall having a front with ports formed therein for passing said liquid with said debris entrained there through, and a rear spaced from said front and formed to urge debris into said nozzle chamber upon movement of said bottom surface along said submerged surface.

22. The portable debris remover of claim 21 in which said bulb has a heel that is substantially rigid as said bulb is operated between said at-rest position and said compressed condition.

23. The portable debris remover of claim 21 further including an extension for connection between said body and said bulb, said extension being sized in length to position said bulb proximate the surface of liquid with said nozzle positioned proximate said submerged surface.

24. The portable debris remover of claim 1 wherein said liquid is water.

25. The portable debris remover of claim 10 wherein said liquid is water.

* * * * *